US005304414A

United States Patent [19]

Bainbridge et al.

[11] Patent Number: 5,304,414

[45] Date of Patent: Apr. 19, 1994

[54] NON-LAMINATED WOVEN SAILCLOTH

[75] Inventors: Robert H. Bainbridge, South Windsor; Terry L. Cronburg, Coventry, both of Conn.; Harry Pattison, Laguna Niguel, Calif.

[73] Assignee: Challenge Sailcloth, Vernon, Conn.

[21] Appl. No.: 808,683

[22] Filed: Dec. 17, 1991

[51] Int. Cl.[5] ..... D04B 1/00

[52] U.S. Cl. ..... 428/229; 114/103; 139/420 R; 428/225; 428/257; 428/260; 428/902

[58] Field of Search ..... 428/257, 258, 259, 229, 428/226, 245, 902, 225, 260; 114/103; 139/420 R

[56] References Cited

U.S. PATENT DOCUMENTS

| | | | |
|---|---|---|---|
| 4,444,822 | 4/1984 | Doyle et al. | 428/257 |
| 4,554,205 | 11/1985 | Mahr | 428/253 |
| 4,590,121 | 5/1986 | Mahr | 428/257 |
| 4,902,548 | 2/1990 | Serpoud et al. | 428/257 |
| 4,906,506 | 3/1990 | Nishimura et al. | 428/257 |
| 4,996,100 | 2/1991 | Druckman | 428/257 |
| 5,082,701 | 1/1992 | Craven et al. | 428/257 |

*Primary Examiner*—James J. Bell

*Attorney, Agent, or Firm*—McCormick, Paulding & Huber

[57] ABSTRACT

The warp and weft yarns are woven either conventionally, one over the other, or with certain reinforcing yarns being woven over several yarns. The majority of the warp and weft yarns have a tensile modulus of 100 grams/denier or less. The reinforcing yarns have a tensile modulus of 500 grams per denier or greater. The majority comprise Dacron type polyester yarns. The reinforcing yarns (every 5th–100th) are Kevlar or Spectra.

12 Claims, 1 Drawing Sheet

NON-LAMINATED WOVEN SAILCLOTH

The present invention relates to woven sailcloth, and deals more particularly with a non-laminated sailcloth fabric which sailcloth is reinforced without requiring the application of laminated scrims or film to the woven fabric.

BACKGROUND OF THE INVENTION

In recent years the sail making industry has adopted laminated sailcloths incorporating scrims of high modulus materials to reinforce the underlying sailcloth. These laminates have consisted of one or more layers of nonwoven plastic film (such as polyester, nylon or tedlar) adhered to the sailcloth substrate. Another approach has been to provide a woven ply on the sailcloth substrate and adhering the two plies together. See for example U.S. Pat. No. 4,554,205 issued to Peter Mahr in 1985.

These types of laminated sailcloth are designed to minimize the stretch of the cloth in the sail under wind loading by providing the reinforcements in line with the high load directions within the sail. The film on the sailcloth controls the stretch in the bias direction (that is in a direction at an angle between the warp and the weft thread line directions). Experience has shown that these laminated sailcloths eventually delaminate with age, use and exposure to the elements. In addition, the films used tend to crease and exhibit a shrinkage with use which tends to degrade the designed in shape provided by the sailmaker so that the sail will assume that shape when deployed.

The object of the present invention is to provide a single ply woven sailcloth capable of absorbing wind loadings both in the direction of the thread line yarns and in the bias direction without the use of laminates.

SUMMARY OF THE INVENTION

In accordance with the present invention and improved sailcloth is provided having a single non-laminated ply which ply is of woven construction having warp and weft yarns. A majority of the warp and the weft yarns have a tensile modulus in the range of 20 to 100 grams per denier. Every Nth warp warn comprises a reinforcing yarn and has a tensile modulus above 500 grams per denier.

The improved sailcloth of the present invention also has several weft or fill yarns of increased tensile modulus and the fractional number of high tensile warp and weft yarns is preferably in the range between one out of five and one out of one hundred.

The preferred material chosen for insertion in the weave either in the warp or the weft or both directions is a synthetic material selected from the group consisting of DuPont Kevlar and Allied Fibers Spectra yarn filaments.

DETAILED DESCRIPTION

Figure 1:
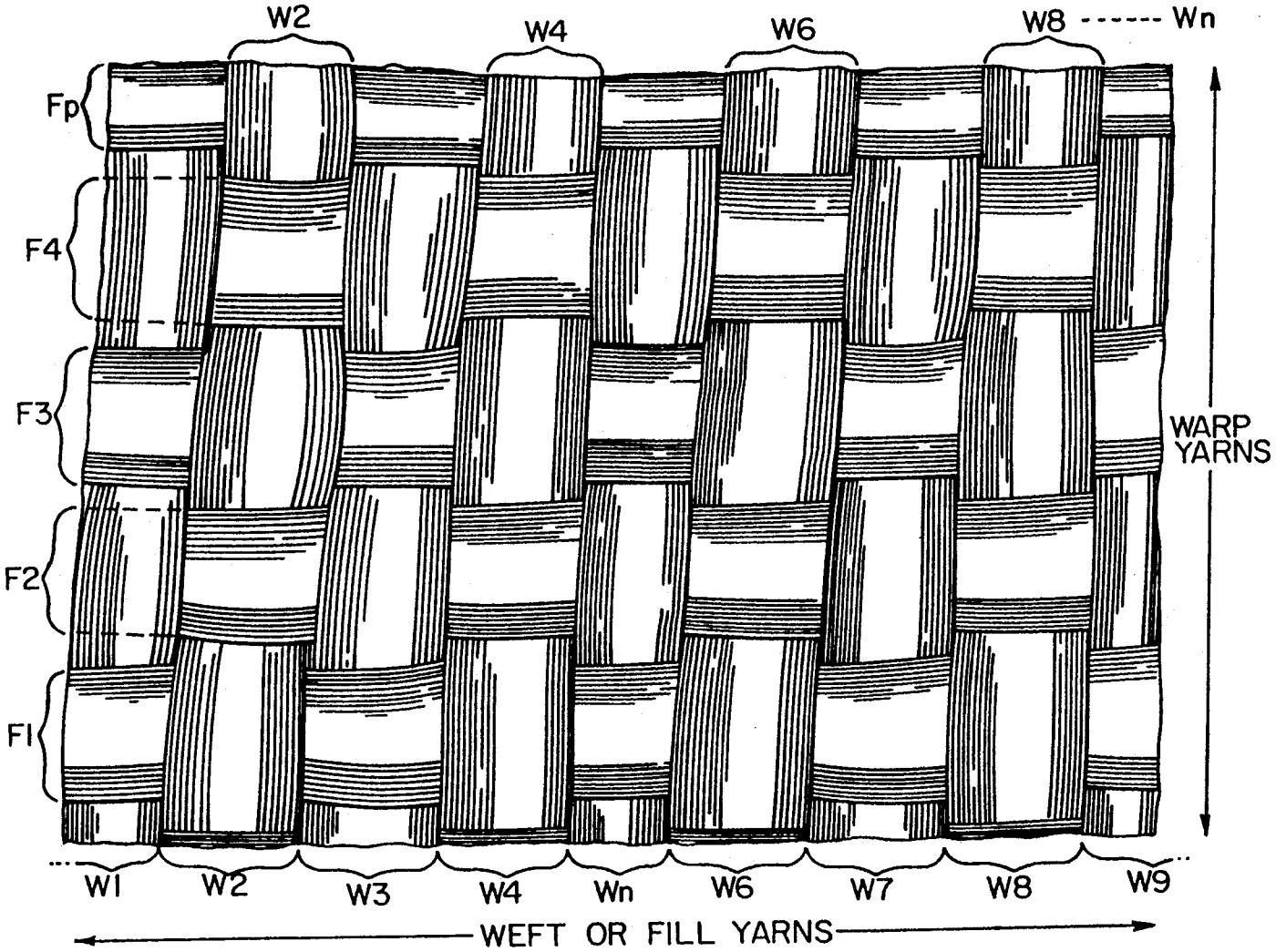
FIG. 1 is a magnified view of a typical woven sailcloth.

A typical Dacron sailcloth material comprises warp and weft (or fill) yarns which are woven as suggested in FIG. 1. The warp yarns generally tend to be of greater density or denier then are the yarns provided in the weft or fill direction. This result can be attributed to the basic fact that the material is produced on present day textile machines in which the warp yarns are more conveniently handled than are the weft or fill yarns. In a typical Dacron or polyester sailcloth of single ply, such as that shown in FIG. 1, the range of denier for these yarns may be between 30 and 1,500. Denier is defined as the weight in grams of a 9,000 meter length of such yarn. These yarns are woven to a density of between 140 to the inch and 30 to the inch depending upon the denier of the yarn used, and on whether the yarn is used in the warp or the weft direction.

In preparing sailcloth according to the present invention an array of reinforcing yarns is provided in the warp of the fabric, or in both the warp and the weft, while maintaining conventional denier ranges for both the warp and weft yarns. This is preferably accomplished by substituting for the polyester or Dacron yarn reinforcing yarns of material having a tensile modulus in the range above 500 grams per denier. Typically, Dacron or polyester have a tensile modulus in the range of 20 to 100 grams per denier.

With particular reference to FIG. 1, the sailcloth shown has weft or fill yarns F1, F2, F3, F4 and Fp which are interwoven with warp yarns identified by references W1, W2, W3, W4, Wn and W6. In a sailcloth woven in accordance with the present invention every Nth warp yarn Wn is preferably fabricated from a high tensile modulus synthetic material such as Kevlar or Spectra. Kevlar is a trademark of DuPont and is an aramid. Spectra is a trademark of Allied Signal and is an ultra-high molecular weight polyethylene. Furthermore, and still in accordance with the present invention every Pth or fill yarn Fp for example is also fabricated from a high strength reinforcing yarn selected from the group consisting of Kevlar or Spectra. Preferably, the range for both Wn and Fp is between 5 and 100. That is, one out of every five or every one hundredth warp and/or weft yarns may be of the high tensile modulus variety referred to herein as Kevlar or Spectra.

Whereas sailcloths have generally been reinforced heretofore with high modulus materials to reduce stretch these materials have been bonded or otherwise adhered to the sailcloth substrate with a resinous type adhesive. The present invention binds the reinforcing yarns into the woven sailcloth by the weaving operation itself. Thus, the sailcloth fabric is not laminated, and does not suffer from the disadvantages mentioned previously with respect to laminated sailcloths generally. The woven sailcloth which results is nevertheless capable of withstanding the loads imposed upon it in much the same manner as prior art laminated sailcloth generally. This advantage is realized without sacrifice to stretch resistance, flexibility, stability and durability.

In an alternative embodiment of the sailcloth fabric described above, other weave patterns will also exhibit the same or improved results. For example, the reinforcing warp yarns can be woven over and under every two to five weft yarns (rather than every other weft yarn as shown in FIG. 1). This weave pattern in which the reinforcing yarn weaves over and under multiple weft yarns reduces the crimp in the reinforcing yarn. This means the yarn is straighter resulting in a lower stretch fabric. Similarly the reinforcing yarns in the weft direction can also be woven over and under every two to five warp yarns.

Finally, it should be mentioned that the sailcloth described herein is itself woven from synthetic yarns, and therefore does lend itself to resinous reinforcement by conventional calendering, a process whereby the sailcloth is passed between rollers after having been impregnated with a resinous material. This conventional treatment for woven sailcloth made from synthetic yarn material provides added strength to the sailcloth, and also reduces the porosity of the sailcloth.

Kevlar is available from DuPont. Spectra is available from Allied Signal. Both products are sold under U.S. federally registered trademarks.

The invention claimed is:

1. An improved sailcloth comprising a single non-laminated ply, said ply having woven warp and weft yarns, a majority of said warp and weft yarns having a tensile modulus in the range of 20–100 grams per denier, every Nth warp yarn being a reinforcing yarn having a tensile modulus above 500 grams per denier.

2. The sailcloth according to claim 1 wherein N is a number in the range between 5 and 100.

3. The sailcloth according to claim 1 wherein every Pth weft yarn has a tensile modulus above 500 grams per denier and serves as a reinforcing yarn in a direction generally perpendicular that of said warp reinforcing yarns.

4. The sailcloth according to claim 3 wherein P is a number in the range between 5 and 100.

5. The sailcloth according to claim 1 wherein said reinforcing yarn is selected from the group consisting of aramid and ultra-high molecular weight polyethylene DuPont Kevlar and Allied Signal Spectra.

6. The sailcloth according to claim 3 wherein every high modulus reinforcing yarn is selected from the group consisting of aramids and ultra-high molecular weight polyethylenes.

7. The sailcloth according to claim 1 wherein said one of N warp yarns is woven over M weft yarns and then under M weft yarns, where M is a number in the range between 1 and 5.

8. The sailcloth according to claim 1 wherein said single ply further includes a synthetic resin provided in the interstices between said warp and weft yarns for additional strength and reduced stretch of the reinforced cloth.

9. The sailcloth according to claim 1 wherein said reinforcing yarns have a denier in the same range as the denier of the majority of said warp yarns.

10. The sailcloth according to claim 3 wherein said reinforcing weft yarns have a denier in the same range as the denier of the majority of said weft yarns.

11. An improved sailcloth comprising a single non-laminated ply, said ply having woven warp and weft years, a majority of said warp and weft yarns having a tensile modulus in the range of 20–100 grams per denier, a minority of weft yarns having a tensile modulus above 500 grams per denier to act as reinforcing yarns in a direction generally perpendicular that of said warp yarns.

12. An improved sailcloth comprising a single non-laminated ply, said ply having woven warp and weft years, a majority of said warp and weft yarns having a tensile modulus in the range of 20–100 grams per denier, a minority of warp yarns having a tensile modulus above 500 grams per denier to act as reinforcing yarns in a direction generally perpendicular that of said weft yarns.

* * * * *